US006309522B1

(12) United States Patent
Strutt et al.

(10) Patent No.: US 6,309,522 B1
(45) Date of Patent: Oct. 30, 2001

(54) ELECTROLYTIC CELL

(75) Inventors: Ivan Strutt, Chester; Julian Dudley Routh, West Midlands, both of (GB)

(73) Assignee: Capital Controls Ltd. (GB)

( * ) Notice: Subject to any disclaimer, the term of this patent is extended or adjusted under 35 U.S.C. 154(b) by 0 days.

(21) Appl. No.: 09/488,272

(22) Filed: Jan. 20, 2000

(30) Foreign Application Priority Data

Jan. 21, 1999 (GB) ..... 9901336

(51) Int. Cl.[7] ..... C25B 9/00; C25C 7/00; C25D 17/00

(52) U.S. Cl. ..... 204/263; 204/253; 204/252

(58) Field of Search ..... 204/252, 253, 204/254, 255, 257, 256, 263

(56) References Cited

U.S. PATENT DOCUMENTS

| | | | | |
|---|---|---|---|---|
| 4,210,511 | * | 7/1980 | Campbell | 204/256 |
| 4,233,146 | | 11/1980 | Rothmayer et al. . | |
| 4,463,064 | * | 7/1984 | Ruch et al. | 429/27 |
| 4,886,586 | | 12/1989 | Morris . | |
| 4,898,653 | | 2/1990 | Morris . | |

FOREIGN PATENT DOCUMENTS

| | | |
|---|---|---|
| 0056503 | 7/1982 | (EP) . |
| 2280433 | 2/1976 | (FR) . |
| 8100863 | 4/1981 | (WO) . |

* cited by examiner

*Primary Examiner*—Kathryn Gorgos
*Assistant Examiner*—Wesley A. Nicolas
(74) *Attorney, Agent, or Firm*—Thomas J. Engellenner; Tram Anh T. Nguyen; Nutter, McClennen & Fish, LLP

(57) ABSTRACT

An electrolytic cell includes at least a first and a second, generally planar, membrane-supporting frame each having a plurality of through-holes. Each is sealed to a plurality of annular coupling members located between the frames and generally aligned with a respective through-hole of each frame to thereby define a plurality of sealed conduits through the frames. Each coupling member is attached in a sealed relationship to the first frame by a number of bolts passing through oversized holes in the first frame so as to be capable of movement parallel to the plane of the first frame during assembly of the cell and is sealed to the second frame at a cylindrical interface which provides sealing at a range of distances between the first and second frames. This construction reduces the manufacturing tolerances required for the cell components.

9 Claims, 8 Drawing Sheets

ELECTROLYTIC CELL

This invention relates to an electrolytic cell and in particular, but not exclusively, an electrolytic cell for the production of chlorine gas by electrolysis of hydrochloric acid.

A known design of such a cell is a series of planar electrodes suspended in a circulating electrolyte across which a voltage is applied. A membrane is supported to cover each electrode to provide separation of the hydrogen and chlorine gas produced by the electrolysis of the electrolyte, which gases are then separately extracted from the cell.

The heat produced by the electrolysis process is removed from the cell by the circulation of the electrolyte but will still subject the cell components to a range of operating temperatures in a given work cycle.

Such a stack of electrode/membrane components has been formed by stacking a series of frames interposed between the electrodes and membranes to form sealed interfaces with them, and to form common manifolds for transporting the electrolyte to and from the electrodes and membranes of the cell sealing being obtained by applying pressure to the stack by clamping them together. A disadvantage of this approach is that all the seals are, in effect, fully formed at the same time as the pressure is applied to the stack and failure of one seal can mean having to reassemble a large part or all of the structure. Particular difficulty is associated with the formation of the manifold seals a construction requires the components to be manufactured to close dimensional tolerances. Thermal cycling also introduces physical stresses that can prejudice seal security during use of the cell.

The present invention, in a first aspect, seeks to provide an electrolytic cell which can be securely assembled from elements with reduced dimensional tolerances and less prone to disturbance when thermally cycled. Accordingly there is provided an electrolytic cell including a first and a second, generally planar, membrane-supporting frame each having a plurality of through-holes and each sealed to a plurality of annular coupling members located between the frames and generally coaxially with a respective through-hole of each frame to thereby define a plurality of sealed conduits through the frames and each coupling member is attached in a sealed relationship to the first frame so as to be capable of movement parallel to the plane of the first frame during assembly of the cell and is sealed to the second frame at a cylindrical interface which provides sealing over a range of distances between the first and second frames.

The frames of the cell of the present invention may be intercoupled by a method according to a second aspect of the present invention which includes the steps of: mounting the second frame in a partially formed electrolytic cell; attaching the plurality of coupling members to the first frame so as to form a seal between each coupling member and the first frames; adjusting the position of the coupling members on the first frame so the plurality of coupling members can be engaged in a sealed relationship with the second frame; and sealing engaging the plurality of coupling members with the second frame thereby forming the plurality of sealed conduits.

The seals between the coupling members and the first frame are securely formed on attaching the coupling members to the frame prior to mounting in the part assembled cell. The first frame and coupling members are then offered up to the second frame with any slight dimensional differences in the plane of frames being accommodated by lateral movement of the coupling members on the first frame.

As will be described in more detail below, an electrode may be sealed between the first and second frames whose thickness will determine the distance between the frames. As the coupling members attached to the first frame are sealed at a cylindrical interface which provides sealing over a range of inter-frame distances, sound sealing is obtainable over a range of electrode thicknesses so lowering the need for high tolerances in the production of the electrode also.

The conduit formed by the through-holes and annular coupling member are part of common manifolds in the assembled cell. It will be appreciated that each manifold is formed fully sealed in stages as the frames are mounted in the cell.

The coupling member may include a ring seal at an annular interface between the coupling member and the first frame and in which the ring seal is retained in an annular groove in the coupling member, for example.

The cylindrical interface may be formed between a radially inner cylindrical surface of the coupling member and a radially outer surface of a circular wall of the second frame and in which a ring seal is retained in a circular groove formed in the inner cylindrical surface of the coupling member, for example. Such a circular wall is conveniently defined by an annular recess formed about a through-hole of the second frame.

Preferably, each coupling member is attached to the first frame by a plurality of threaded fastening members located in oversize through-holes formed in the annular recess of the first frame and threadingly engaged with the coupling member. For example, the threaded fastening members may be bolts and the heads of the bolts located at least partially within an annular recess of the coupling member.

Preferably, the frames and coupling members are formed of the same material in order to provide thermal matching of the components.

The electrolytic cell of the present invention has elements which can be simply machined and assembled as the claimed construction removes the necessity for very tight tolerances on both material supplies and machining.

BRIEF DESCRIPTION OF THE DRAWINGS

An embodiment of the invention will now be described, by way of example only, with reference to the accompanying drawings of which:

Referring to FIGS. 1 and 2, an exemplary embodiment of an electrolytic cell 100 according to the present invention includes a series of three membrane-supporting frames 102,104,106 each associated with a respective electrode assembly commonly designated 108 and a membrane commonly designated 114. Embodiments may be constructed with only two such frames or many more such frames and certainly cells with up to 25 frames are considered practicable with the present invention.

Figure 1A:
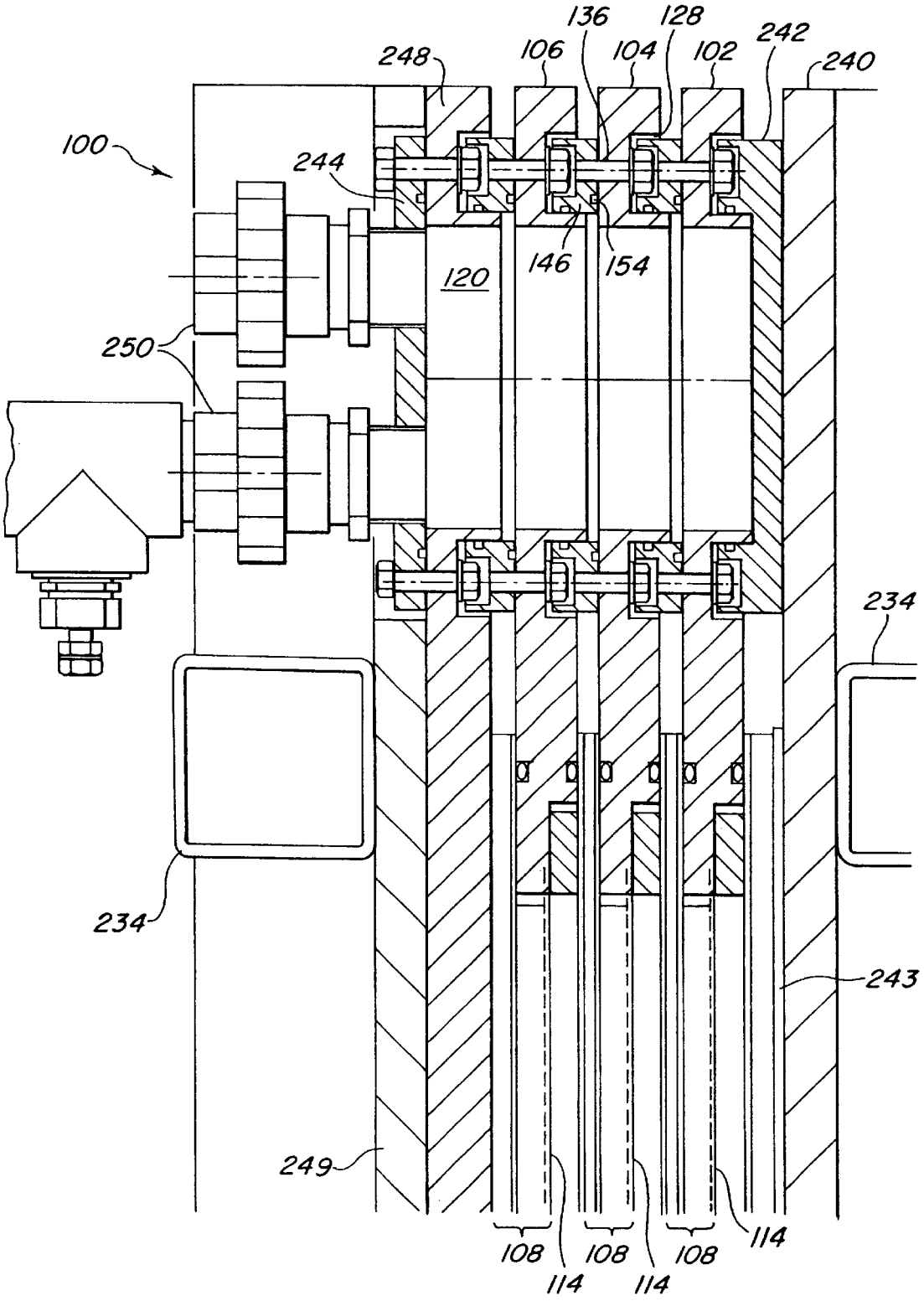
FIGS. 1A and 1B are vertical, cross-sectional part views of an embodiment of the electrolytic cell according to the present invention.
Figure 1B:
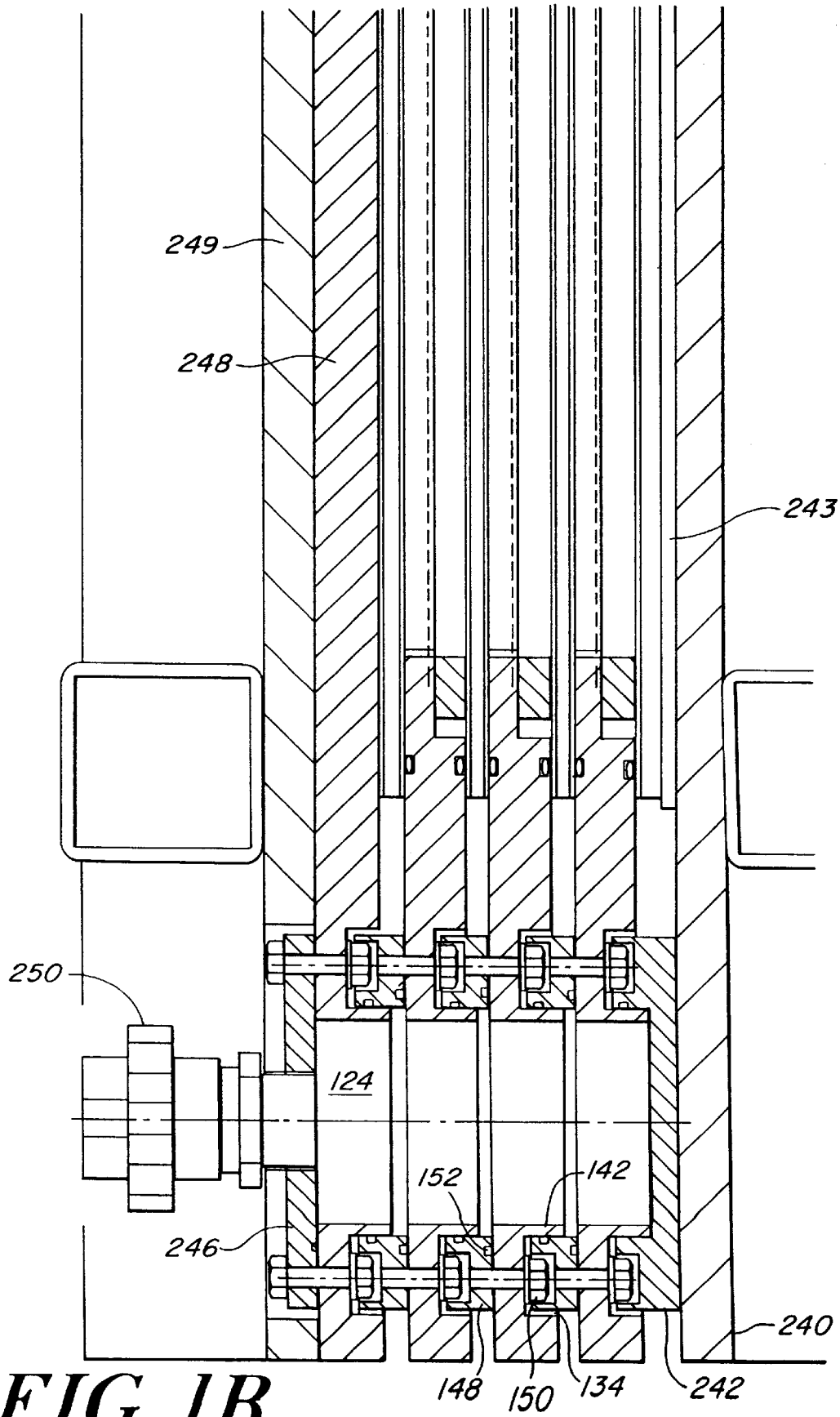
Figure 2A:
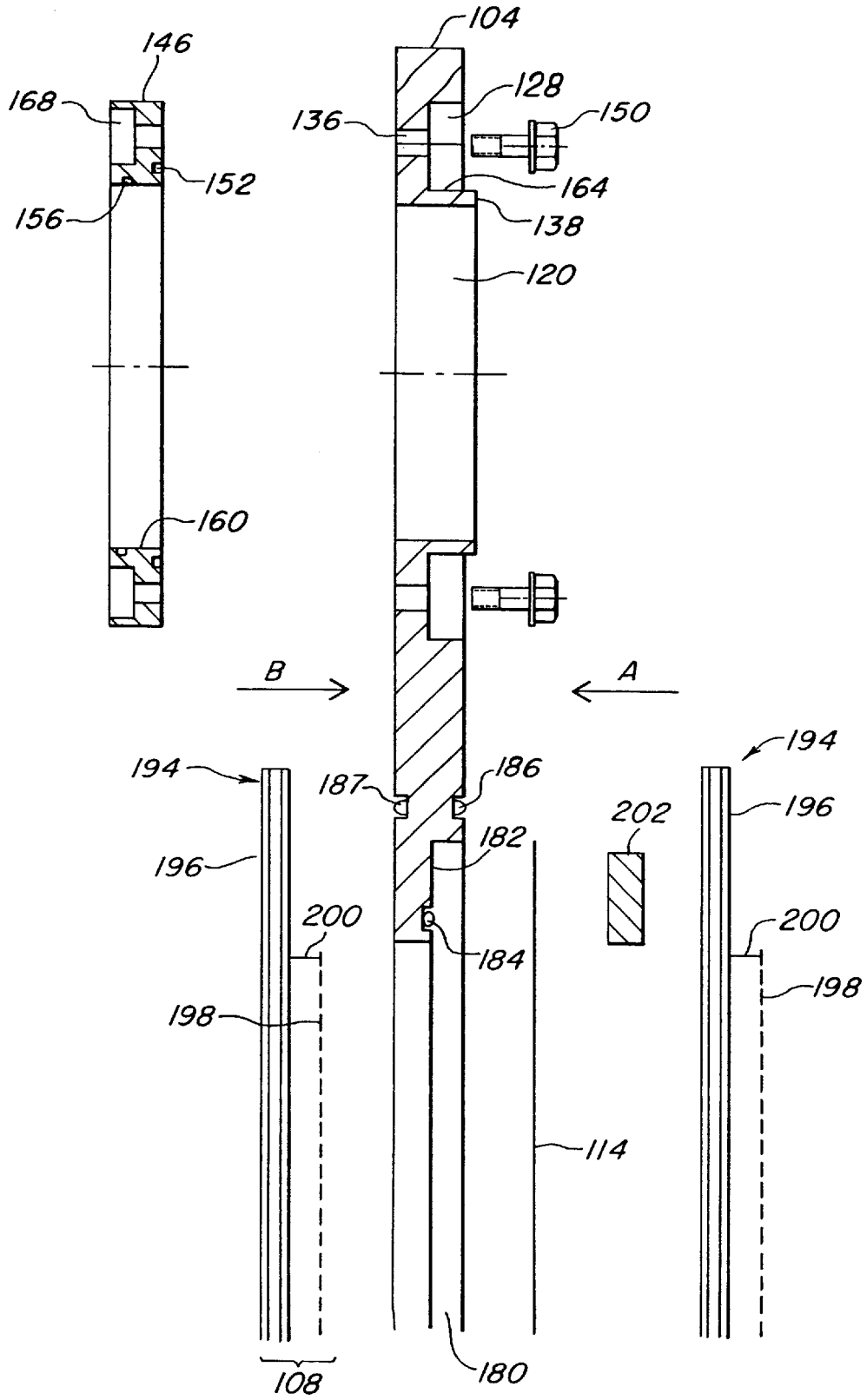
FIGS. 2A and 2B are vertical, cross-sectional, exploded part views of part of the cell of FIG. 1.
Figure 2B:
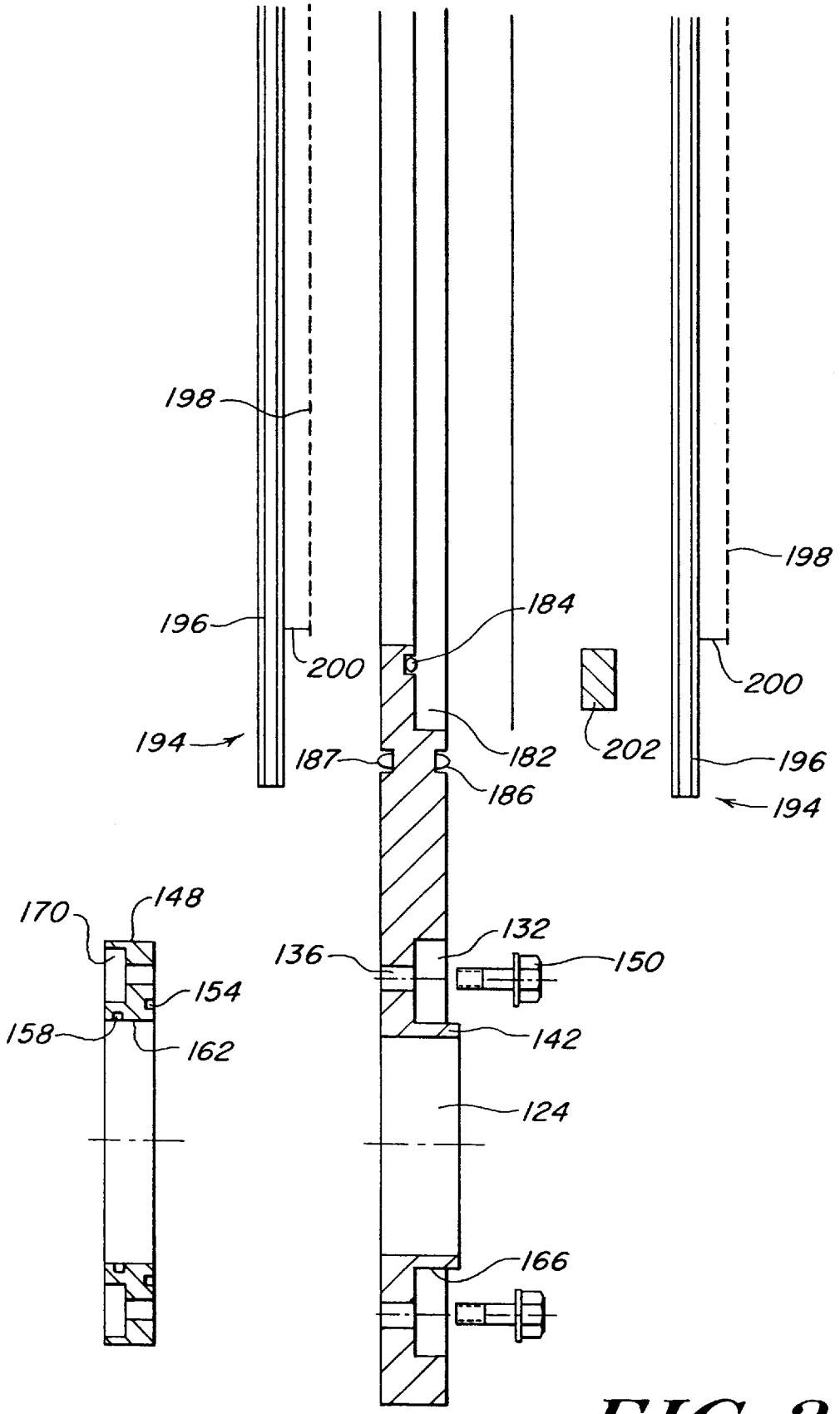

Each frame 102, 104, 106 has four through-holes with common designations 120, 122, 124, 126 two of which are shown in FIGS. 1 and 2, the upper two through-holes 120, 122 being of larger diameter than the lower two through-holes 124, 126. Each of through-holes 120, 122, 124, 126 is surrounded by a respective annular recess 128, 130, 132, 134 in the frame 102, 104, 106, with eight through-holes, 136, equally spaced round the base of each recess. The through-holes 120, 122, 124, 126 and respective surrounding annular recesses 128, 130, 132, 134 together define a respective circular wall 138, 140, 142, 144 which is formed to stand proud of the adjacent planar surface of the frame 102, 104, 106.

Figure 5:
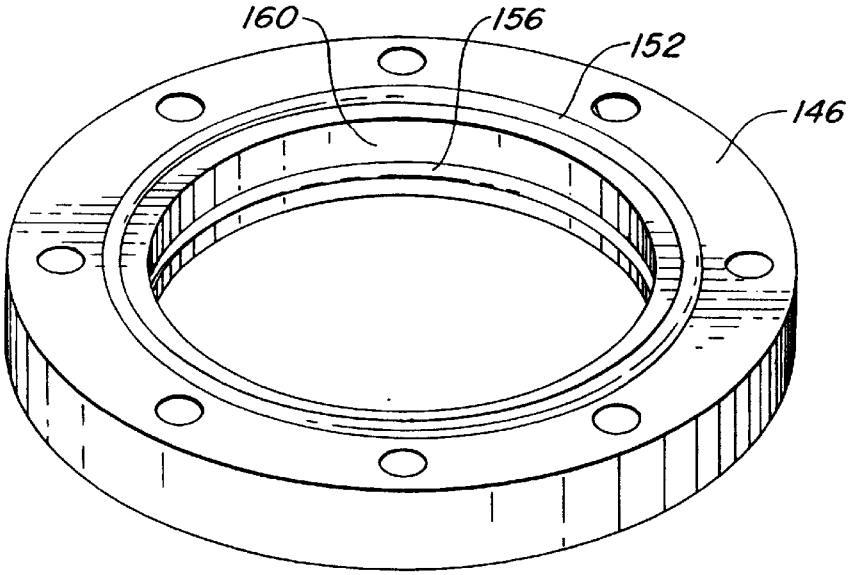
FIG. 5 is an isometric view of an upper connector of the cell of FIG. 1.

Two larger diameter annular coupling members 146 (as shown in FIG. 5) are attached to each frame 102, 104, 106 by bolts 148 which are undersized in holes 136, the coupling members 146 being generally aligned with the two larger through-holes 120, 122, as shown in FIG. 1. Similarly, two smaller diameter coupling members 148 are attached to each frame 102, 104, 106 by bolts 150 which are undersized in holes 136, the coupling member 148 being generally aligned with the two smaller through-holes 124, 126, also as shown in FIG. 1.

O-ring seals 152, 154 set in retaining grooves in the larger and smaller coupling members 146, 148 seal the interface between the frames 102, 104, 106 and the coupling members 146, 148. Because the through-holes 136 are oversized relative to the bolts 148, 150, the coupling members 146, 148 can, to some degree, move laterally relative to the frames 102, 104, 106 after attachment while continuing to be securely sealed together.

O-ring seals 156, 158 are set into the cylindrical inner surfaces 160, 162 of the larger and smaller coupling members 146, 148, which surfaces are of diameters which are a push fit on the outer cylindrical surfaces 164, 166 of the walls 138, 142 of the next adjacent frame, the interface so formed being sealed by a respective seal 156, 158.

An annular recess 168, 170 in each of the larger and smaller coupling members 146, 148, respectively, accommodates the head of the bolts 150 of the adjacent frame with sufficient clearance to allow the above described lateral movement of the coupling members 146, 148 on the frames 102, 104, 106 during assembly.

Each frame 102, 104, 106 has a generally rectangular aperture 180 having a stepped sidewall including a peripheral sealing ledge 182 in which is set a rectangular seal 184. The aperture 180 is circumscribed on each side of the frame 102, 104, 106 by a respective seal 186, 187.

The top edges of the apertures 180 are both slightly arched upwards to encourage flow of the electrolyte to the respective exit through-holes from the apertures 180.

Figure 8:
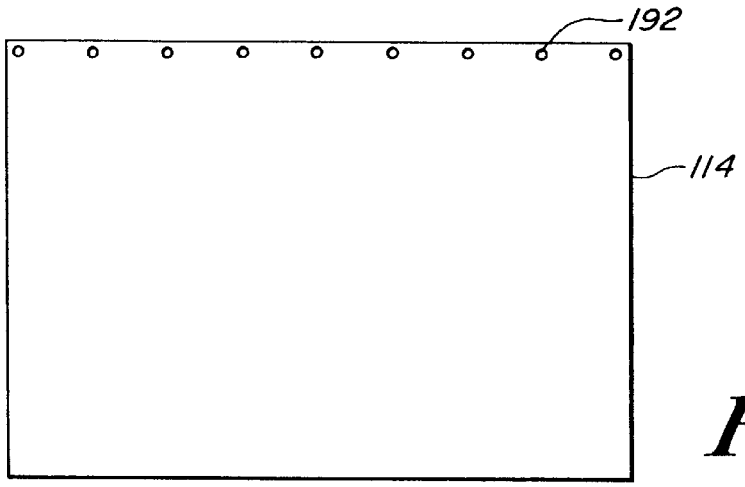
FIG. 8 is an end view of a membrane of the cell of FIG. 1.
Figure 9:
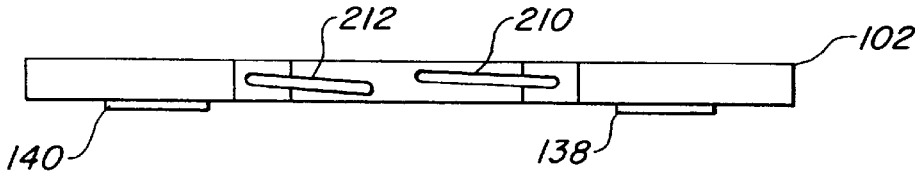
FIG. 9 is a top view of the membrane-supporting frame of FIGS. 3 and 4.

A number of membrane support pegs 188 extend outwardly from the sealing ledge 182 above the seal 184 on which the membranes 114 (see FIG. 8) are temporarily supported during assembly of the cell by inserting them through matching holes 192 in the membrane 114.

Electrode assemblies 108 include an electrode back plate 196 dimensioned so as to seal to the frame seals 186 and 187 in the assembled cell and which supports an expanded metal electrode mesh 198 on supports 200 so it is positioned adjacent a membrane 114 of the assembled cell.

A generally rectangular, open sub-frame 202 with cross-member 204 is dimensioned to fit within the aperture 180 and so as to sit on the sealing ledge 182 of each frame 102, 104, 106 and urge the membrane 114 into sealed relationship with the seal 184 set in the seal ledge 182 when pressed by an electrode plate 196.

An electrolytic cell sub-unit is defined between the consecutive pairs of electrode plates 196 sealed to each side of a given frame 102, 104, 106, the aperture 180 of the frame of each such cell being divided into catholytic and anolytic cell sections by the respective membrane 114 supported by within a frame 102, 104, 106.

The catholyte and anolyte are circulated to the electrolytic cell subunits by respective common manifolds 124 and 126 and from the electrolytic cell by respective common manifolds 120 and 122, which are of larger diameter than the manifolds 124 and 126 to handle the additional volume due to the gases generated by the cell during its operation. The electrolytes are passed to the aperture 180 of a given frame by pipes 206, 208, and from the aperture by pairs pipes 210 and 212 all coupled to a respective conduit passing through the frame to the respective manifold 120, 122, 124, 126. Two exit pipes being provided, in view of the additional volume to be removed from the frame compared to what is input into the frame.

The pipes 210 and 212 are coupled to the through-holes in the frame which enter the manifolds 120 and 122 towards their tops so as to electrically isolate the acid entering a manifold from liquid already present.

Figure 11:
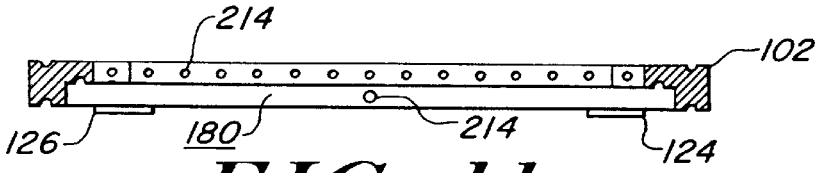
FIG. 11 is a cross-sectional view of the membrane-supporting frame taken in the direction XI—XI of FIG. 3.

Referring to FIG. 11, a catholyte input conduit 214 passes generally vertically from the lower edge of each frame 102, 104, 106 to the catholyte cell side of each membrane 114 at the lower inner edge of the frame aperture 180 and is coupled to input pipe 206. A pair of output conduits (not show) in the upper edge of the frame are coupled to one of the output pipes 210.

Figure 10:
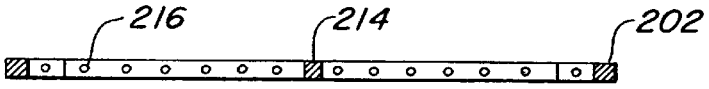
FIG. 10 is a cross-sectional view of the membrane-coupling frame taken in the direction X—X of FIG. 7.

Each sub-frame 202 has a series of through-holes 216 through the upper and lower edges of the sub-frame 202, as shown in FIG. 10, the sub-frame 202 being provided with stand-offs 218 so when the sub-frame is mounted in the aperture 180 of a frame 102, 104, 106, a cavity is formed for the distribution and collection of the catholyte to or from the pipes 200 and 210 respectively. Each sub-frame 202 is provided with a number of drillings (not shown) which engage with the membrane locating pins 188 of the frame. On pushing home the sub-frame 202 the membrane 114 is pushed against the seal 184 and when the electrolytic cell stack is closed up the seal is held together by an adjacent frame. The centre bar 204 of the sub-frame 202 is sufficient to hold the membrane 114 against the mesh electrode 198.

Figure 4:
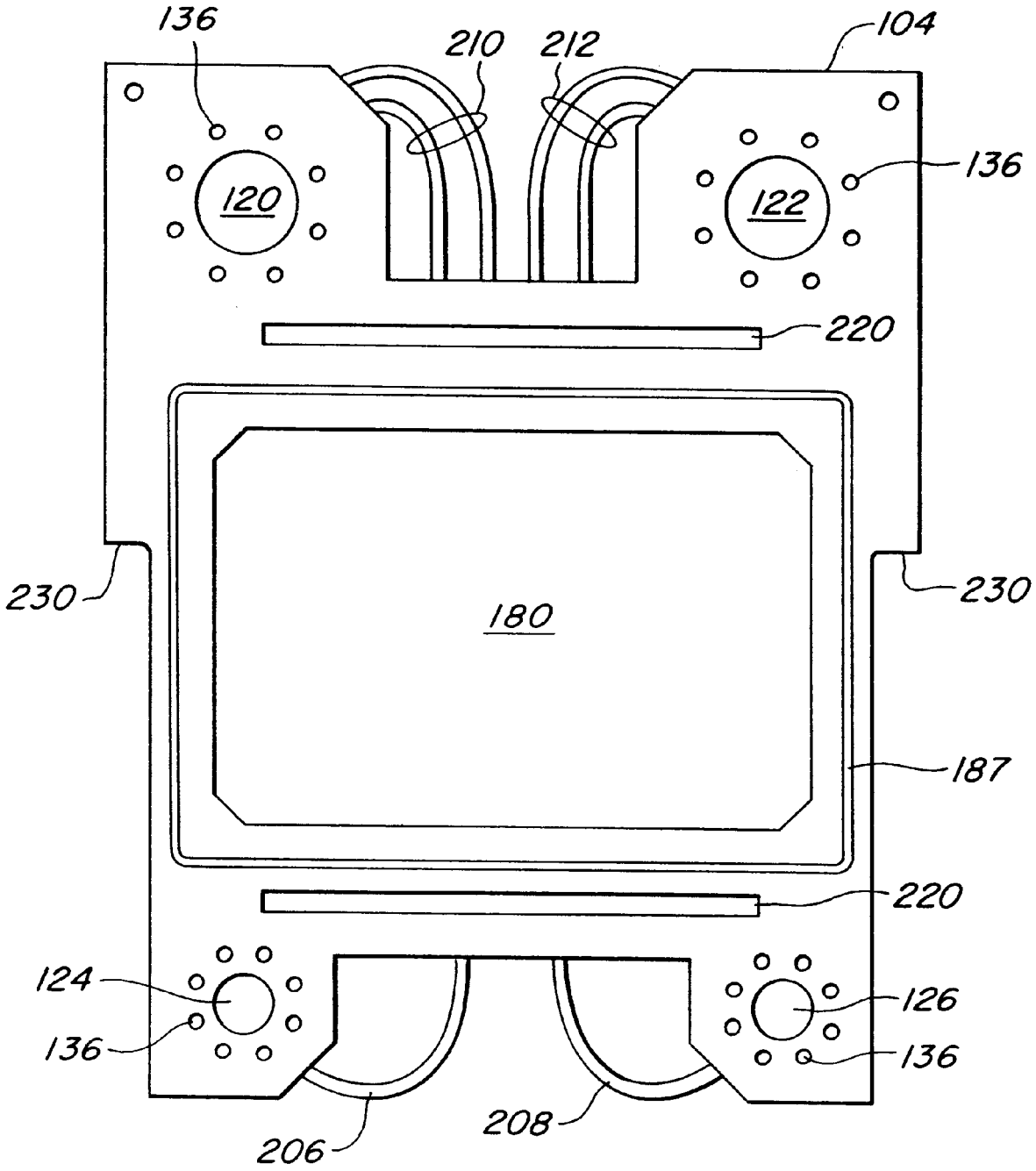
FIG. 4 is an end view of the membrane-supporting frame of FIG. 3 viewed in the direction B of FIG. 2A.

Referring now to FIGS. 4 and 11, covered recesses 220, formed by capping grooves previously milled into each frame 102, 104, 106, are coupled via through-holes (not shown) in the frame 102, 104, 106 to pipes 208 and 212. The recesses 220 are in fluid communication with the interior of the aperture 180 of the frame 102, 104, 106, via a number of through-holes 214. The covered recesses 220 distribute and collect the anolyte from and to the pipes 208 and 212 from the aperture 180 of the frames 102, 104, 106.

The provisions of the many through-holes to feed the electrolytes to the membrane ensures the flow of the electrolytes are evenly spread across the area of the electrodes.

The seals 184 and 186 have, in this embodiment, a Shore hardness of 60 and 80, respectively so the outer seal determines the degree of sealing. The inner seal 184 is not fully clamped up but this is not important as small leaks across this seal 184 are not important.

All the seals of the cell may be covered with a suitable grease, for example a fluorocarbon grease.

Referring to FIG. 1, the electrolytic cell includes an end plate 240 which presses four manifold capping members 242 and an electrode plate 196 (but with no mounted electrode mesh), the latter by means of an interposed insulating plate 243, against the end frame 102 of the stacked frames. The capping members 242 are as the coupling members 146, 148 on one side so they can seal similarly to the adjacent frame 102 but each has a cylindrical recess rather than a through-hole thereby sealing the end of the manifolds.

The other end of the cell assembly includes a plate 248 which is as the frames 102, 104, 106 at the manifold region but with a flat central section which serves to press an electrode plate 196 against the frame 106 to seal with it when itself pressed by an endplate 249 abutting the central portion of the plate 248.

The manifolds are completed by end plates 244, 246 of appropriate diameter fastened to the plate 248 in the same manner the coupling members 146 are attached to the frames 102, 104, 106, which end plates include similar parts 248 and 250 for the flow of the electrolytes to and from the various manifolds.

In this embodiment the frames are of PVDF and are about 990 mm wide, 1220 mm high and 35 mm thick.

The electrode assembly 108 may be constructed of any suitable materials. In the illustrated embodiment it is constructed as a sandwich of materials. The cathode side of plate 196 is of Hastelloy, the centre supports 200 are aluminium and the anode 198 is coated titanium mesh supported on a titanium plate side of plate 196.

Figure 3:
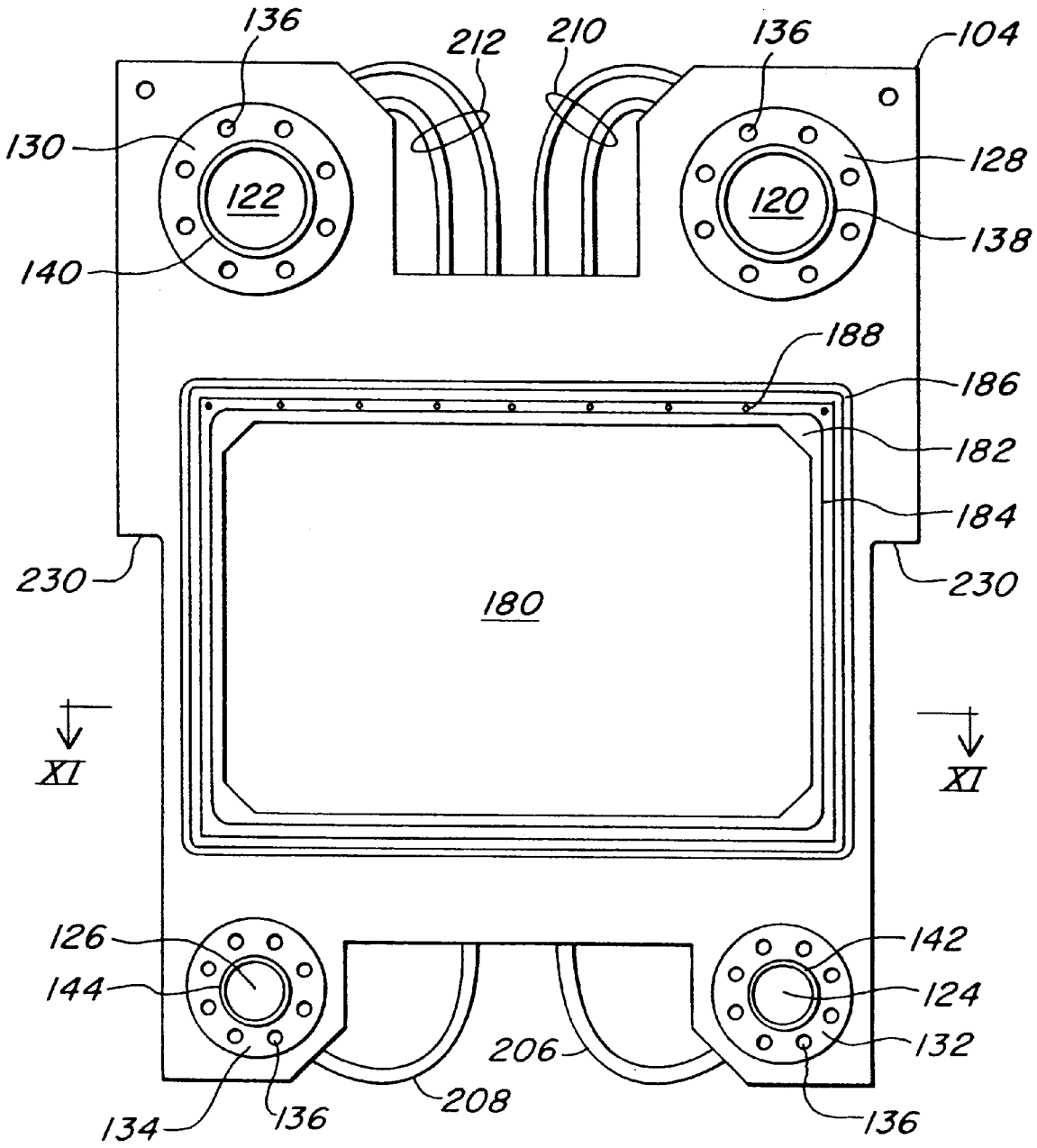
FIG. 3 is an end view of a membrane-supporting frame viewed in the direction A of FIG. 2A.
Figure 6:
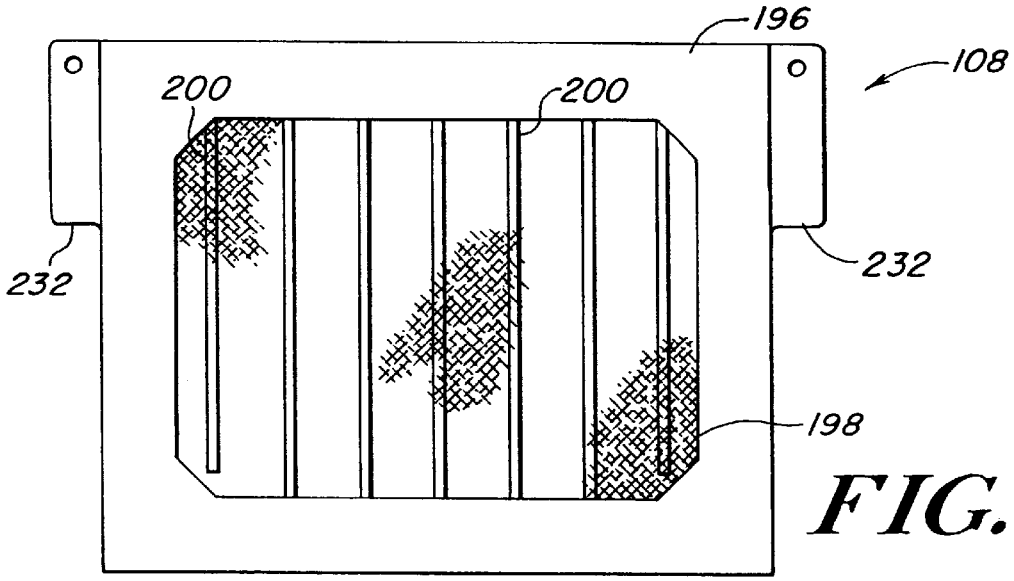
FIG. 6 is an end view of an electrode of the cell of FIG. 1.
Figure 7:
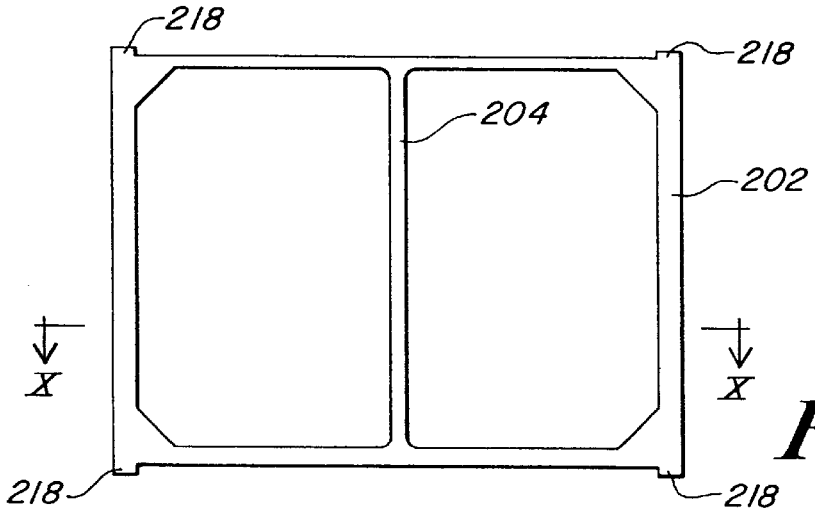
FIG. 7 is an end view of a membrane-coupling frame of the cell of FIG. 1.

Referring to FIGS. 3, 4 and 6, the frames 102, 104, 106 and the electrode 194 have laterally extending shoulders 230, 232 which can rest on suitably distance support bars to facilitate assembly, each new component being slid up to the already assembled components.

As already described, the manifold seals are fully formed during assembly. The electrode frame seals 186, 187 and membrane/frame seals 184 are fully formed by clamping the assembly together by pressing laterally extending pressure beams 234 (see FIG. 1), generally aligned with the transverse portions of the electrode/frame seals 186, 188.

The electrolytic cell operates as follows.

A catholyte and anolyte, each being hydrochloric acid, are pumped into the common manifolds 124 and 126, respectively, passed upwards either side of the membrane 114 within each frame 102, 104 and 106, to exit via pipes 210 and 212 to the upper common manifolds 120 and 122, respectively.

A current of between 50 and 1500 Amps is passed through the cell generating between 5 and 140 kg of chlorine gas per day for the illustrated three-frame cell and an estimated 40 to 1100 kg of chlorine gas per day for a 25-frame cell. The chlorine produced is cooled and then washed to remove as many contaminants as possible.

The cell is operated under vacuum to minimise leakage, hold the minimum inventory of chlorine in the system and also to allow conventional vacuum dosing into water for disinfection, the rate of production being controlled such that the chlorine is produced as required obviating the need for on-site storage of chlorine.

What is claimed is:

1. An electrolytic cell including at least a first and a second, generally planar frame, each frame surrounding and supporting a respective membrane, each frame further having a plurality of through-holes and each frame being sealed to a plurality of annular coupling members located between the frames and generally aligned with a respective through-hole of each frame to thereby define a plurality of sealed conduits through the frames and each coupling member is attached in a sealed relationship to the first frame so as to be capable of movement parallel to the plane of the first frame during assembly of the cell and is sealed to the second frame at a cylindrical interface which provides sealing at a range of distances between the first and second frames.

2. An electrolytic cell as claimed in claim 1 including a ring seal at an annular interface between the coupling member and the first frame.

3. An electrolytic cell as claimed in claim 2 in which the ring seal is retained in an annular groove in the coupling member.

4. An electrolytic cell as claimed in claim 1 in which the cylindrical interface is formed between a radially inner cylindrical surface of the coupling member and a radially outer surface of a circular wall of the second frame.

5. An electrolytic cell as claimed in claim 4 in which a ring seal is retained in a circular groove formed in the inner cylindrical surface of the coupling member.

6. An electrolytic cell as claimed in claim 5 in which the circular wall is defined by an annular recess formed about a through-hole of the second frame.

7. An electrolytic cell as claimed in claim 6 in which each coupling member is attached to the first frame by a plurality of threaded fastening members located in oversize through-holes formed in the annular recess of the first frame and threadingly engaged with the coupling member.

8. An electrolytic cell as claimed in claim 7 in which the threaded fastening members are bolts and the heads of the bolts are located at least partially within an annular recess of the coupling member.

9. An electrolytic cell as claimed in claim 1 in which the frames and coupling members are formed of the same material.

* * * * *